US008944684B2

(12) United States Patent
Bell

(10) Patent No.: US 8,944,684 B2
(45) Date of Patent: Feb. 3, 2015

(54) BAG CONSTRUCTION WITH SIDE GUSSETS

(75) Inventor: Gary Michael Bell, Crystal, MN (US)

(73) Assignee: Ampac Holdings LLC, Cincinnati, OH (US)

( * ) Notice: Subject to any disclaimer, the term of this patent is extended or adjusted under 35 U.S.C. 154(b) by 1677 days.

(21) Appl. No.: 11/960,371

(22) Filed: Dec. 19, 2007

(65) Prior Publication Data

US 2008/0240623 A1 Oct. 2, 2008

Related U.S. Application Data

(63) Continuation-in-part of application No. 11/731,805, filed on Mar. 30, 2007, now abandoned.

(51) Int. Cl.

| | |
|---|---|
| ***B65D 33/14*** | (2006.01) |
| ***B65D 33/10*** | (2006.01) |
| ***B65D 33/16*** | (2006.01) |
| ***B65D 30/20*** | (2006.01) |
| ***B65D 33/00*** | (2006.01) |
| ***B65D 33/02*** | (2006.01) |
| ***B65D 33/25*** | (2006.01) |

(52) U.S. Cl.

CPC ..... *B65D 31/10* (2013.01); *B65D 33/00* (2013.01); *B65D 33/02* (2013.01); *B65D 33/25* (2013.01); *Y10S 383/906* (2013.01)

USPC ..... 383/5; 383/10; 383/31.2; 383/34; 383/67; 383/120; 383/203; 383/906

(58) Field of Classification Search

CPC ... B65D 31/10; B65D 83/06; B65D 2575/586

USPC ..... 383/5, 41, 120, 61, 203, 204, 61.1, 121, 383/10, 61.2, 63, 64, 67, 906

See application file for complete search history.

(56) References Cited

U.S. PATENT DOCUMENTS

| | | | | |
|---|---|---|---|---|
| 3,229,813 A | | 1/1966 | Crowe, Jr., et al. | |
| 3,369,709 A | | 2/1968 | Clauss | |
| 3,567,074 A | | 3/1971 | Brown | |
| 4,576,316 A | * | 3/1986 | Foster | 222/541.6 |
| 4,584,201 A | | 4/1986 | Boston | |

(Continued)

FOREIGN PATENT DOCUMENTS

| | | | | |
|---|---|---|---|---|
| JP | 8-276944 A | | 10/1996 | |
| JP | 09240682 A | * | 9/1997 | B65D 30/10 |

(Continued)

OTHER PUBLICATIONS

U.S. Appl. No. 11/731,754, filed Mar. 2007, Bell.

(Continued)

*Primary Examiner* — Jes F Pascua

(74) *Attorney, Agent, or Firm* — Perman & Green, LLP

(57) ABSTRACT

A bag construction for use to distribute flowable material is provided. The bag construction generally includes a first and second panel sections and one or more side gusset panel sections. An internal gusset member may be positioned inside the bag construction, between the first and second panel sections. A tape is disposed inside the bag construction and secures portions of end edges to other sections. In preferred embodiments, a bag construction includes an openable and reclosable closure arrangement and an anti-tamper arrangement.

6 Claims, 15 Drawing Sheets

(56) References Cited

U.S. PATENT DOCUMENTS

| | | | | | |
|---|---|---|---|---|---|
| 4,936,456 | A | | 6/1990 | Bell et al. | |
| 4,986,673 | A | | 1/1991 | Bell | |
| 5,059,036 | A | | 10/1991 | Richison et al. | |
| 5,060,803 | A | * | 10/1991 | Beer et al. | 383/200 |
| 5,147,272 | A | | 9/1992 | Richison et al. | |
| 5,254,073 | A | | 10/1993 | Richison et al. | |
| 5,392,589 | A | * | 2/1995 | Buchanan | 53/412 |
| 5,709,479 | A | | 1/1998 | Bell | |
| 5,785,428 | A | * | 7/1998 | Mazzocchi | 383/103 |
| 5,882,120 | A | | 3/1999 | Bell | |
| 5,964,532 | A | * | 10/1999 | St. Phillips et al. | 383/5 |
| 5,971,613 | A | | 10/1999 | Bell | |
| 6,126,318 | A | | 10/2000 | Bell | |
| 6,176,615 | B1 | * | 1/2001 | Leimkuehler | 383/211 |
| 6,213,645 | B1 | | 4/2001 | Beer | |
| 6,257,763 | B1 | | 7/2001 | Stolmeier et al. | |
| 6,375,037 | B1 | | 4/2002 | Bell et al. | |
| 6,398,412 | B2 | | 6/2002 | Wedi et al. | |
| 6,423,356 | B2 | | 7/2002 | Richison et al. | |
| 6,499,878 | B1 | * | 12/2002 | Dobreski et al. | 383/5 |
| 6,539,691 | B2 | * | 4/2003 | Beer | 53/459 |
| 6,783,276 | B2 | * | 8/2004 | Machacek et al. | 383/36 |
| 7,040,808 | B2 | * | 5/2006 | Rehwinkel et al. | 383/61.2 |
| 8,137,254 | B2 | * | 3/2012 | DeSmedt | 493/231 |
| 8,277,121 | B2 | * | 10/2012 | Bell et al. | 383/210 |
| 2002/0097923 | A1 | * | 7/2002 | Dobreski et al. | 383/5 |
| 2002/0103067 | A1 | * | 8/2002 | Bois | 493/394 |
| 2003/0179955 | A1 | * | 9/2003 | Rehwinkel | 383/5 |
| 2004/0120613 | A1 | * | 6/2004 | Hanson | 383/120 |
| 2004/0161167 | A1 | * | 8/2004 | Ausnit et al. | 383/5 |
| 2005/0063617 | A1 | * | 3/2005 | Tilman | 383/5 |
| 2006/0228055 | A1 | * | 10/2006 | Eads et al. | 383/61.2 |
| 2007/0133908 | A1 | * | 6/2007 | Bruns | 383/95 |
| 2008/0240626 | A1 | | 10/2008 | Bell | |
| 2008/0253696 | A1 | * | 10/2008 | Haas et al. | 383/10 |

FOREIGN PATENT DOCUMENTS

| | | | | | |
|---|---|---|---|---|---|
| JP | 2000-310835 | A | | 11/2000 | |
| JP | 2002114238 | A | * | 4/2002 | B65D 33/25 |
| JP | 2002145285 | A | * | 5/2002 | B65D 33/25 |
| JP | 2002179086 | A | * | 6/2002 | B65D 30/16 |
| JP | 2004256120 | A | * | 9/2004 | B65D 30/16 |
| JP | 2005008163 | A | * | 1/2005 | B65D 33/36 |
| JP | 2005153974 | A | * | 6/2005 | B65D 33/01 |
| JP | 2005178856 | A | * | 7/2005 | B65D 33/25 |
| JP | 2005-255201 | A | | 9/2005 | |
| JP | 2005255201 | A | * | 9/2005 | B65D 33/25 |
| JP | 2005-280767 | A | | 10/2005 | |
| JP | 2006-036367 | A | | 2/2006 | |
| JP | 2006193173 | A | * | 7/2006 | |
| WO | WO 2008034168 | A1 | * | 3/2008 | B65D 33/25 |

OTHER PUBLICATIONS

International Search Report, dated Oct. 9, 2008, corresponding to PCT/US2008/058717.

International Search Report, dated Oct. 9, 2008, corresponding to PCT/US2008/058691.

* cited by examiner

BAG CONSTRUCTION WITH SIDE GUSSETS

This application is a Continuation-In-Part of U.S. patent application Ser. No. 11/731,805, filed Mar. 30, 2007, now abandoned, and the entirety of the application is incorporated by reference herein for all purposes.

FIELD

The present invention relates to a bag or pouch construction. Embodiments disclosed herein relate to a bag construction having side gussets and an internal gusset with an aperture. The bag construction may be filled with dispersible materials, wherein the arrangement allows a convenient way of distributing the dispersible materials. The present disclosure also relates to a bag construction which allows a convenient way of storing dispersible materials.

BACKGROUND

A wide variety of items comprise materials which, in use, are dispersed or spread over an area. Many of these items include dry powder or particulate materials. The term "dispersible material" as used herein is intended to include at least pellets, grains, powders, gels, liquids and any combinations thereof. Examples of these include, but are not limited to: deicing salts; seeds; insecticides; and chalk.

Some improved arrangements for spreading particulate materials have been disclosed, for example, in U.S. Pat. Nos. 5,882,120 and 5,709,479. The prior art bag constructions may be difficult to store and arrange because the bottom portion does not have an arrangement which allows the prior art bag constructions to stand upright. A storage bag which stands upright for product storage and at point-of-sale is desirable because such a bag construction may provide an easier method of storing and/or stacking of the bag constructions to the distributors and retail merchants. It is also advantageous to have a bag construction that is capable of standing upright at the retail level, because it may provide a simplified arrangement. It is again desirable for bag constructions to stand upright at a point-of-sale so that a consumer may readily view the bag constructions for contemplating the purchase thereof. Additionally, filling the prior art bag constructions by machines may be difficult because the prior art bag construction lacks expandability along the sides or the bottom portion. This may result in difficulties in filling the prior art bag constructions and/or less volume amount of materials being filled into the prior art bag constructions. Furthermore, the rib-and-trough closure system of the prior art bag constructions may be difficult to operate after using the prior art bag construction to distribute materials because particulate materials may get stuck inside the trough portion of the closure system. Undesirably, this may prevent the formation of a proper seal which can lead to leaks of the particulate materials and/or contamination of the particulate materials during storage.

Accordingly, improved arrangements for distributing dispersible materials is desirable.

SUMMARY

Bag construction arrangements are disclosed herein. An embodiment of a bag construction includes first and second opposed panels or panel sections. In one embodiment, each of the panel sections has a first end edge, a second end edge, and a first side edge and a second side edge. The first end edge opposes the second end edge. The first side edge opposes the second side edge. The first side edge extends from the first end edge to the second end edge. The second side edge extends from the first end edge to the second end edge. Thus, first and second end edges and first and second side edges form a plane which generally defines a panel section of the embodiment.

The embodiment also includes at least one side gusset panel section. The side gusset panel section has a first end edge, a second end edge, a first side edge and a second side edge. The first end edge opposes the second end edge. The first side edge opposes the second side edge. The first side edge extends from the first end edge to the second end edge. The second side edge extends from the first end edge to the second end edge.

At least a portion of the first side edge of the first panel section is secured to at least a portion of the second side edge of the side gusset panel section. At least a portion of the first side edge of the side gusset panel section is secured to at least a portion of the second side edge of the second panel section. This arrangement generally defines a bag construction interior.

An embodiment may include a tape disposed transversely on an inside surface of the first panel section securing at least a portion of the second end edge of the first side gusset panel section to at least a portion of the inside surface of the second panel section. In other embodiments, the tape may also secure the second end edge of the second side gusset panel section to at least a portion of the inside surface of the second panel section.

An embodiment includes an internal gusset member, which is positioned inside the bag construction interior. The internal gusset member has at least one distribution aperture, which may be one or more holes, slits, or any combination of these and other apertures.

In another embodiment, it is preferred that the side gusset panel sections have a fold line extending, at least partially, between the first and second side edges of the first and second panel sections.

Another embodiment includes a transverse seal.

A still further embodiment includes an anti-tamper arrangement. The anti-tamper arrangement may include a tear member sealed to each of the first and second panel sections. The anti-tamper arrangement may be positioned inside the bag construction interior. Preferably, the anti-tamper arrangement is positioned between the first and second panel sections and also between the second end edge of the first panel section and the internal gusset member.

DETAILED DESCRIPTION OF THE PREFERRED EMBODIMENT

Figure 1:
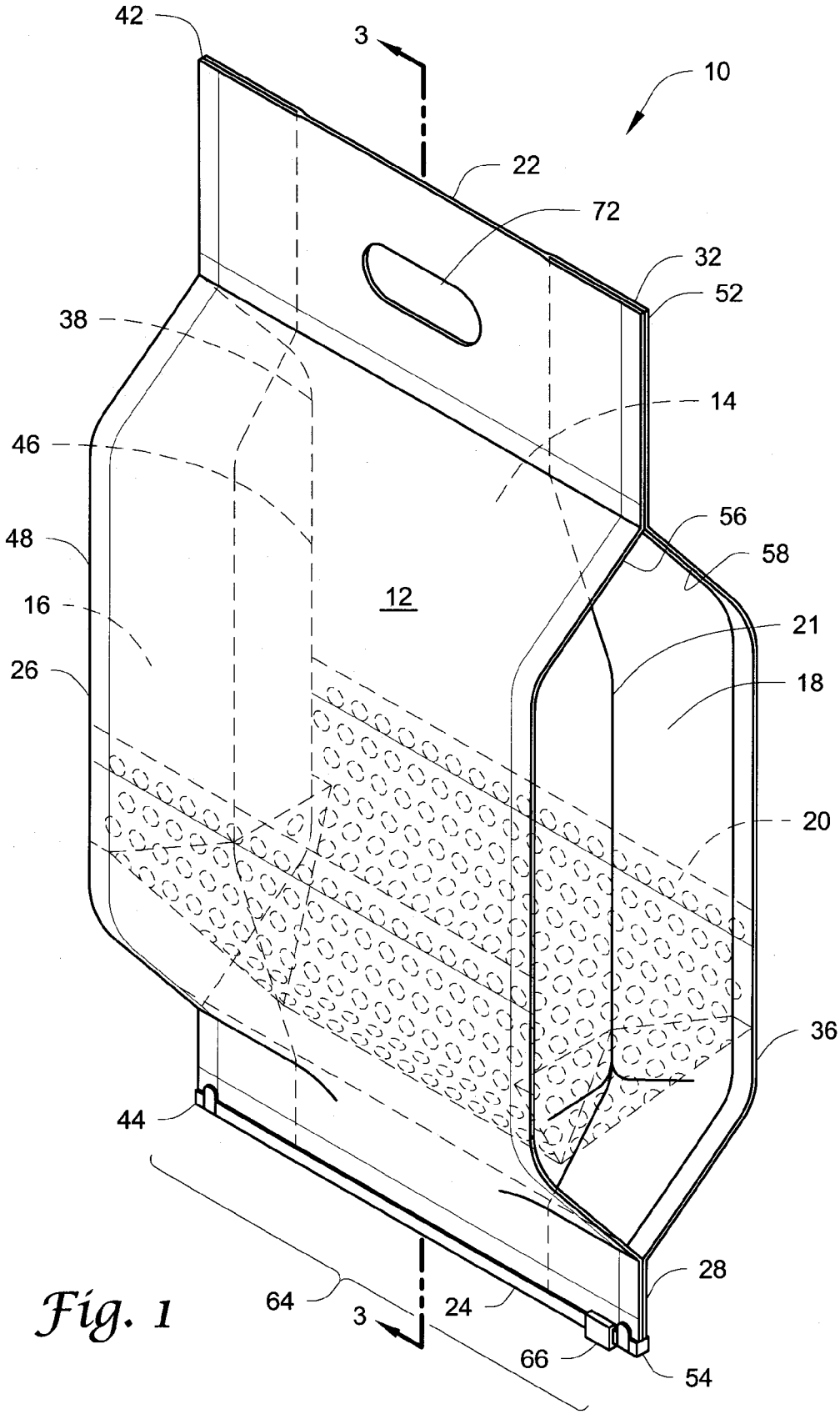
FIG. 1 is a perspective view of a bag construction of an embodiment disclosed herein.
Figure 2B:
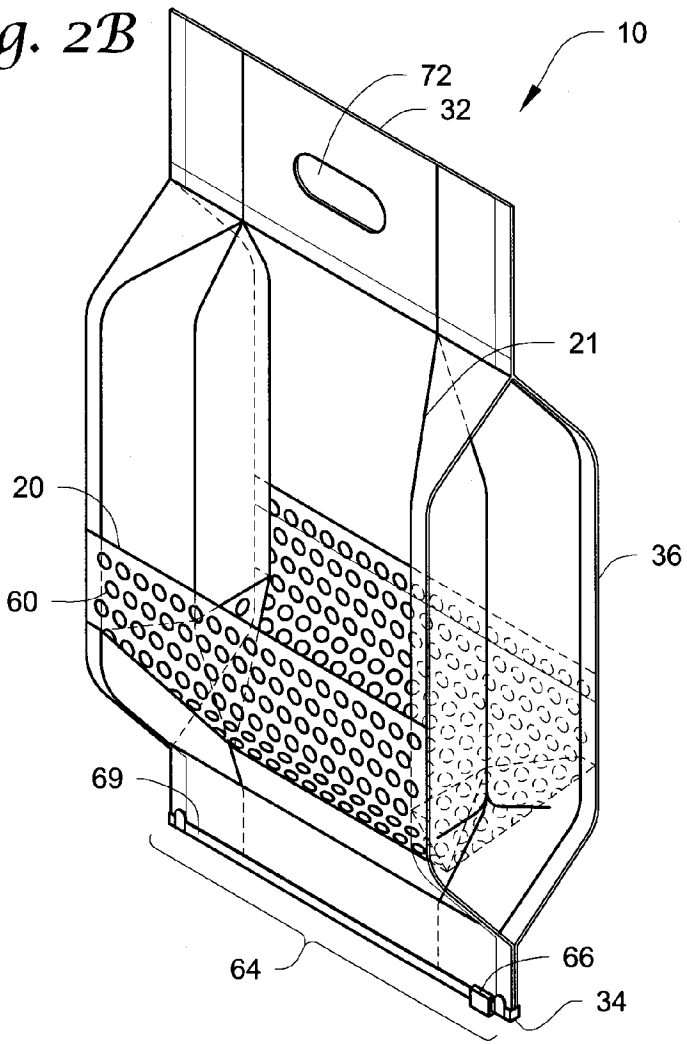
FIG. 2B is a perspective view of the bag construction as shown in FIG. 2A.
Figure 2A:
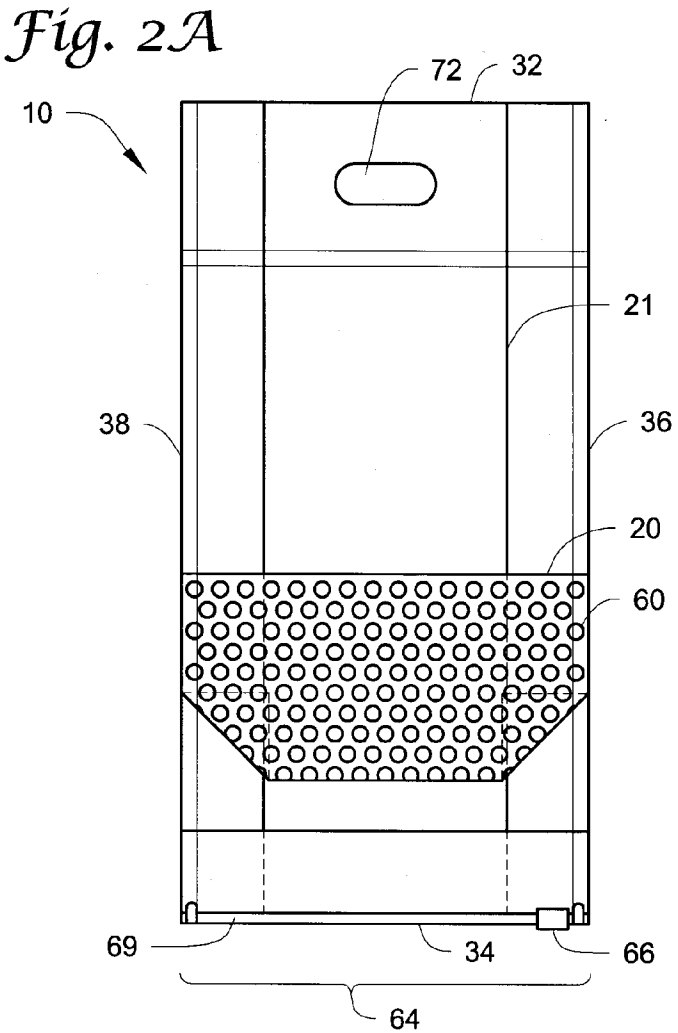
FIG. 2A is a front plan view without showing a facing panel section of the bag construction of FIG. 1.
Figure 3:
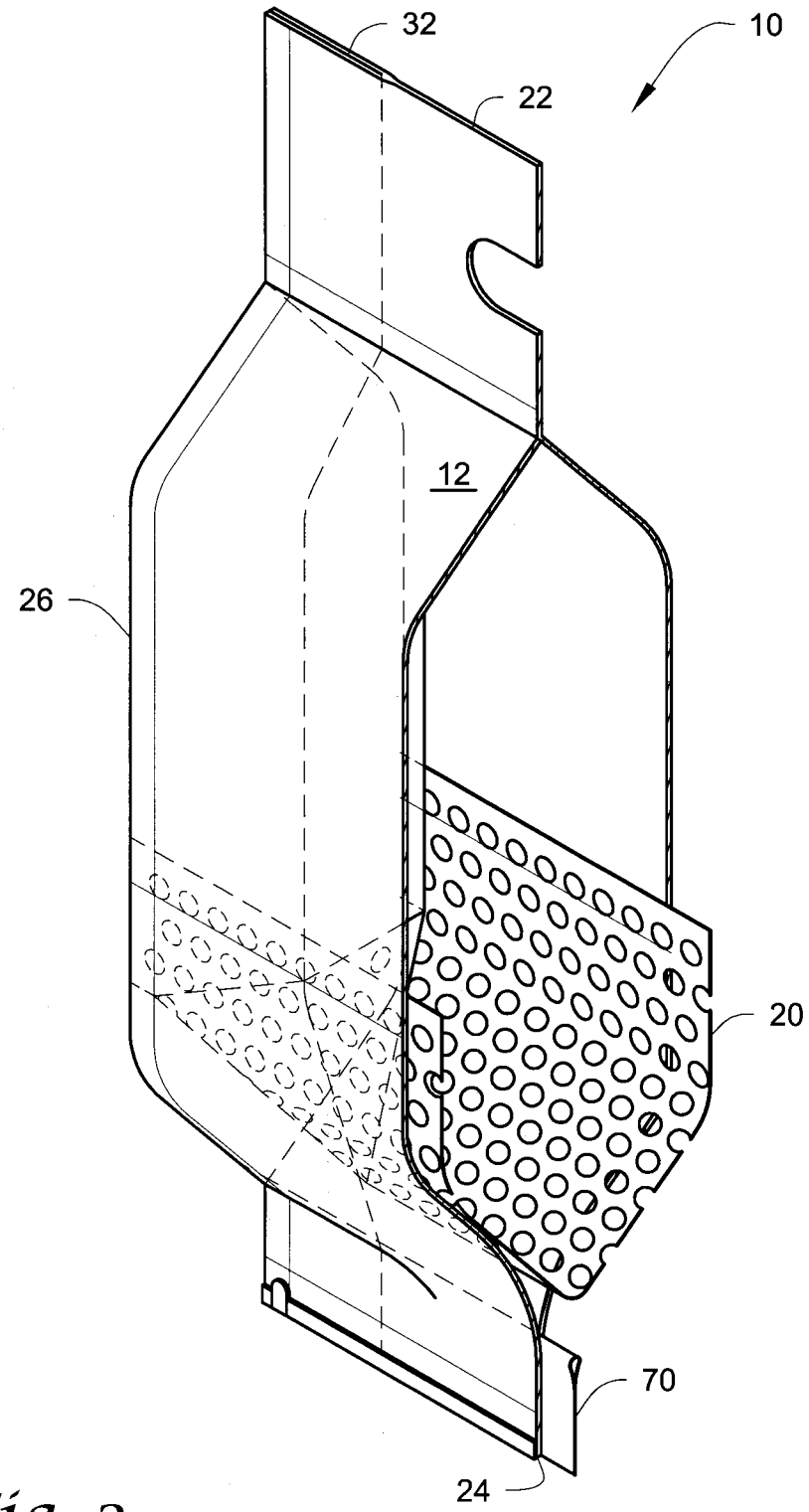
FIG. 3 is a perspective cross-sectional view taken generally along line 3-3, FIG. 1.

A bag construction 10 according to one embodiment is shown in FIGS. 1, 2A, 2B and 3. The bag construction 10 is preferably made from substantially transparent materials. FIGS. 2A and 2B are illustrated without showing a facing first panel section 12 such that the internal details may be seen clearly. FIG. 3 is a cross-sectional view of FIG. 1, generally along line 3-3 to show the internal details of the bag construction 10. It will be apparent to those skilled in the art that non-transparent materials may also be utilized to make bag constructions. Accordingly, in other embodiments, a bag construction may be made from substantially nontransparent materials. Generally, many different types of materials may be used to construct the bag construction 10. Some examples of materials include, but are not limited to, polymers, cloth, metal, paper, composites, and any combinations thereof. It will be apparent to those skilled in the art that many other materials may also be utilized, in combinations and/or in layers.

Referring to FIG. 1, the bag construction 10 is shown as it would generally appear prior to use. The bag construction 10 shown in FIG. 1 is shown without any material contained inside to facilitate viewing of internal detail. Positioning of material to be distributed will be apparent from descriptions below.

Still referring to FIG. 1, bag construction 10 comprises first panel section 12 opposed to second panel section 14; first side gusset panel section 16 opposed to second side gusset panel section 18; and internal gusset member 20 positioned inside the bag construction 10. It is preferable that the first or second side gusset panel sections include a fold line 21 (see FIGS. 2A and 2B).

Still referring to FIG. 1, the first panel section 12 comprises a first end edge 22, a second end edge 24, a first side edge 26, and a second side edge 28. The first end edge 22 opposes the second end edge 24. The first side edge 26 opposes the second side edge 28.

The second panel section 14 comprises a first end edge 32, a second end edge 34, a first side edge 36, and a second side edge 38. The first end edge 32 opposes the second end edge 34. The first side edge 36 opposes the second side edge 38.

The first side gusset panel section 16 comprises a first end edge 42, a second end edge 44, a first side edge 46, and a second side edge 48. The first end edge 42 opposes the second end edge 44. The first side edge 46 opposes the second side edge 48.

The second side gusset panel section 18 comprises a first end edge 52, a second end edge 54, a first side edge 56, and a second side edge 58. The first end edge 52 opposes the second end edge 54. The first side edge 56 opposes the second side edge 58.

Referring still to FIG. 1, at least a portion of the first panel section's first side edge 26 is secured to at least a portion of the first side gusset panel section's second side edge 48. At least a portion of the first side gusset panel section's first side edge 46 is secured to at least a portion of the second panel section's second side edge 38. At least a portion of the second panel section's first side edge 36 is secured to at least a portion of the second side gusset panel section's second side edge 58. And, at least a portion of the second side gusset panel section's first side edge 56 is secured to at least a portion of the first panel section's second side edge 28. Some examples of securing methods that can be utilized include, but are not limited to: heat sealing, glues, sewing, and/or any combinations there of. Conventional seals for the formation of pouch construction are known in the art, such as those illustrated in U.S. Pat. Nos. 5,059,036; 5,147,272; and 5,254,073. Those skilled in the art will appreciate that there are many different methods of securing the aforementioned panel sections in the aforementioned configuration to form the bag construction according to the present invention.

In FIGS. 2A and 2B, the internal gusset member 20 can be seen to be perforated and has at least one distribution aperture 60. In FIGS. 2A and 2B, the distribution aperture 60 is shown to be a hole, but other forms and shapes may also be utilized. Preferably, shapes, sizes, and forms of distribution aperture 60 will be selected to allow for desirable passage of dispersible materials 62 in a desirable manner, as illustrated for example in FIG. 7. Desirable manner may include the rate of flow of dispersible materials 62, size of a surface area formed by distribution of dispersible materials 62, or shape formed of dispersible materials 62 when distributed onto a surface. Preferably, the internal gusset member 20 is made, in part, of a flexible material. Examples of flexible material that may be suitable include, but not limited to: laminations, cork extruded materials, polymers, cloth fabric, paper, weaved synthetic materials, weaved natural materials, and sheet of organic material.

Figure 4B:
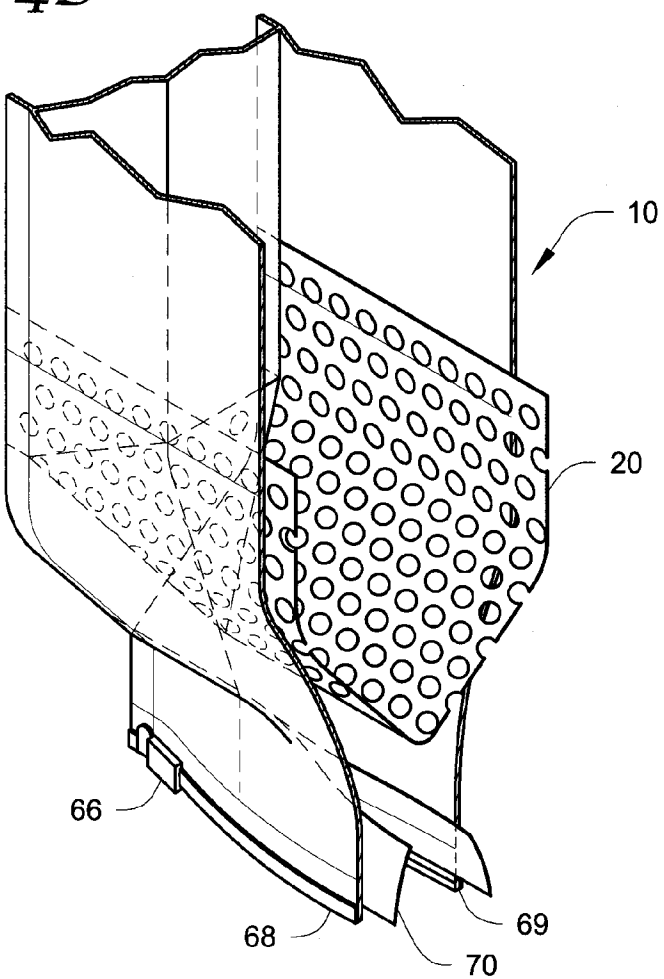
FIG. 4B is the portion of a perspective cross-sectional view of the bag construction as shown in FIG. 4A, with the anti-tamper seal arrangement opened.
Figure 4A:
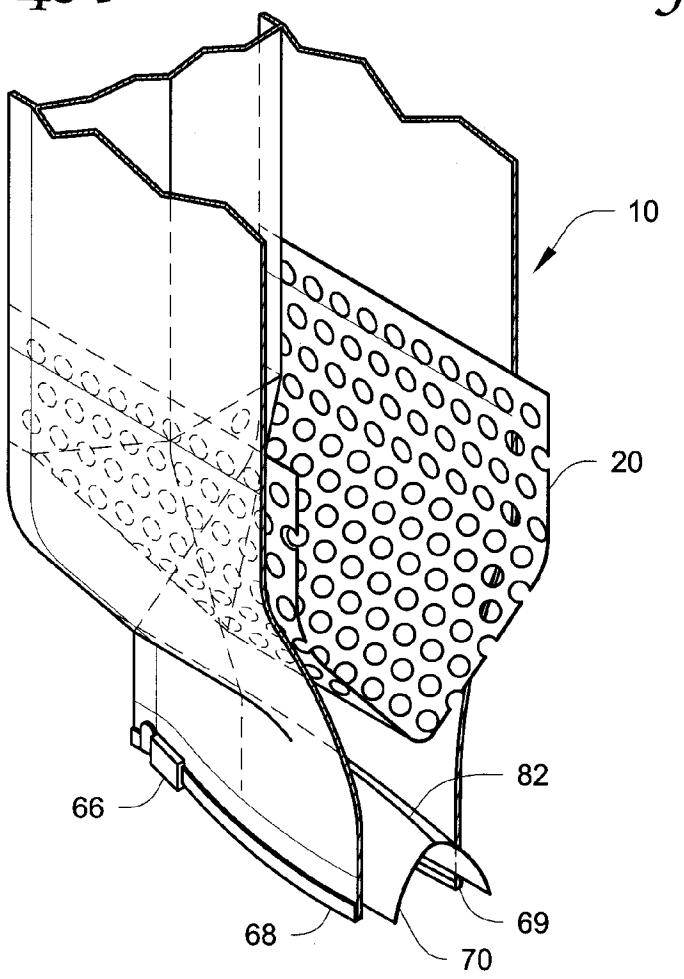
FIG. 4A is a portion of a perspective cross-sectional view of the bag construction shown in FIG. 3, with a transverse openable and reclosable closure mechanism opened and anti-tamper seal arrangement intact.
Figure 10:
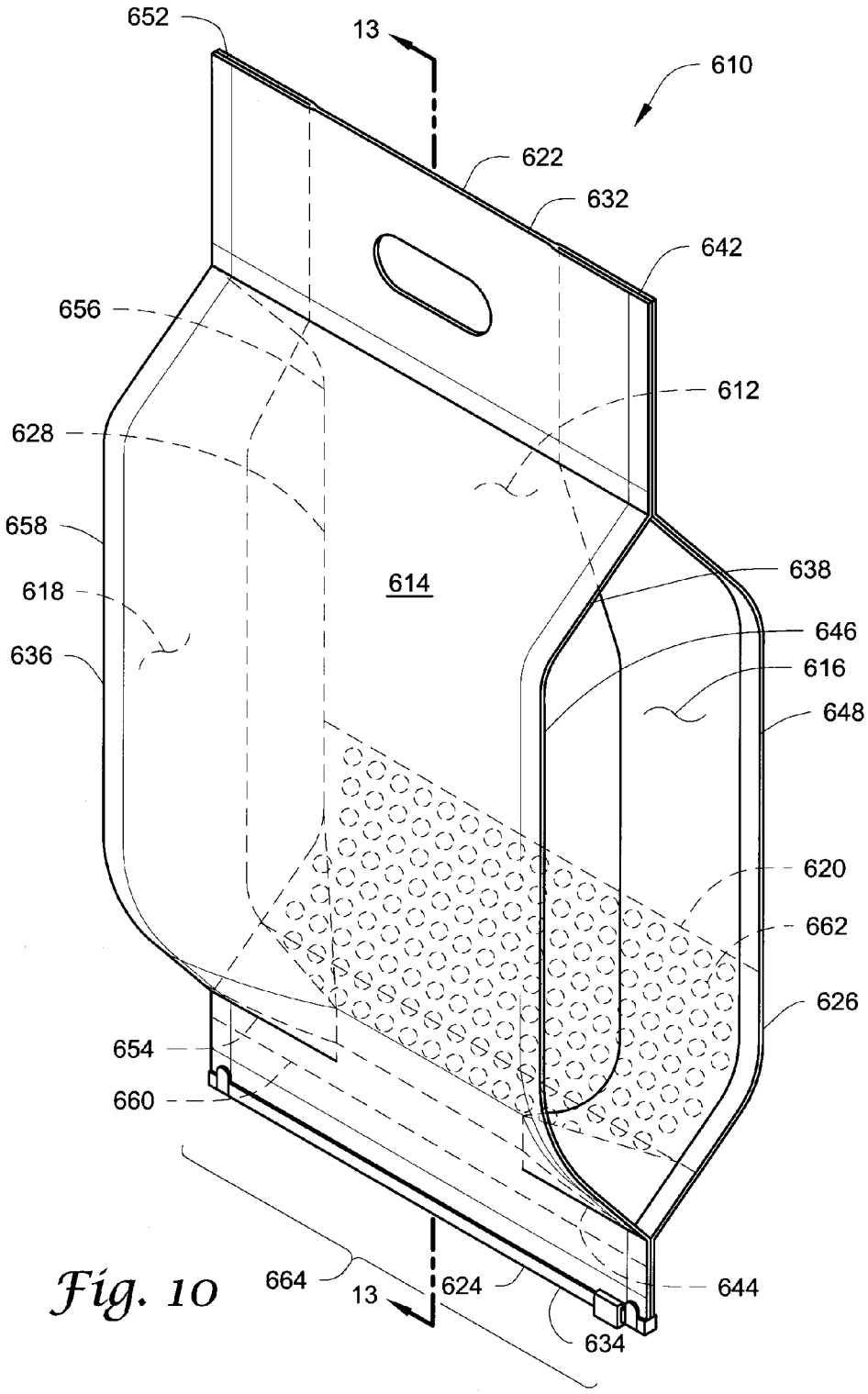
FIG. 10 is a perspective view of a bag construction disclosed herein.
Figure 13:
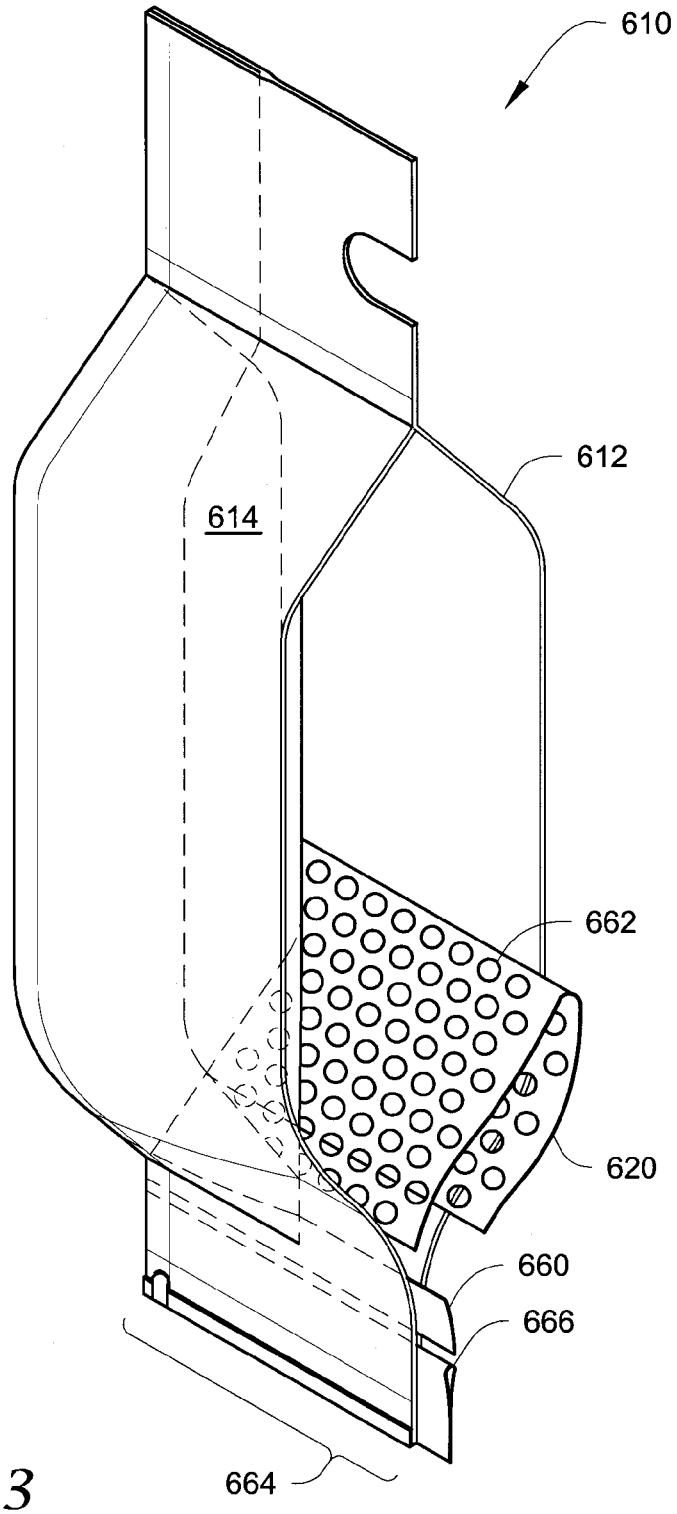
FIG. 13 is a perspective cross-sectional view taken generally along line 13-13, FIG. 10.
Figure 14:
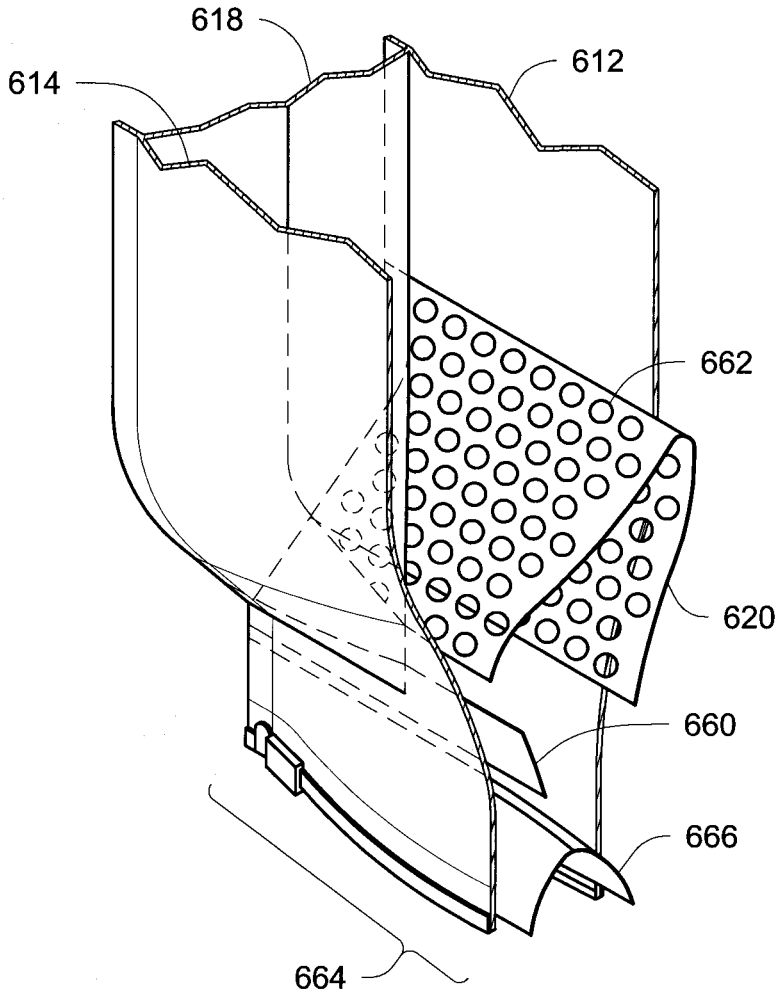
FIG. 14 is a portion of a perspective cross-sectional view of the bag construction shown in FIG. 13, with a transverse openable and reclosable closure mechanism opened and anti-tamper seal arrangement intact.

FIGS. 1, 2A, 2B, 3, 4A, 4B, 10, 13, and 14 illustrate an openable and reclosable closure arrangement wherein the openable and reclosable closure arrangement extends substantially from one side of the bag construction to an opposing side. The illustrated openable and reclosable closure arrangement is a sliding zipper 64 type of an arrangement. This particular arrangement provides a first panel section 12 and second panel section 14 of the bag construction 10 to be closed or opened by movement of a slidable tab 66 positioned along the sliding zipper rails 68, 69. In FIG. 1, a closed state of the sliding zipper 64 is illustrated. In FIG. 4A, an open state of the sliding zipper 64 is illustrated. Similarly, FIGS. 10 and 13 illustrate closed states of a closure arrangement. FIG. 14 illustrates an open state of a closure arrangement. Similar openable and reclosable closure arrangements may be used in all of the embodiments herein.

Figure 7:
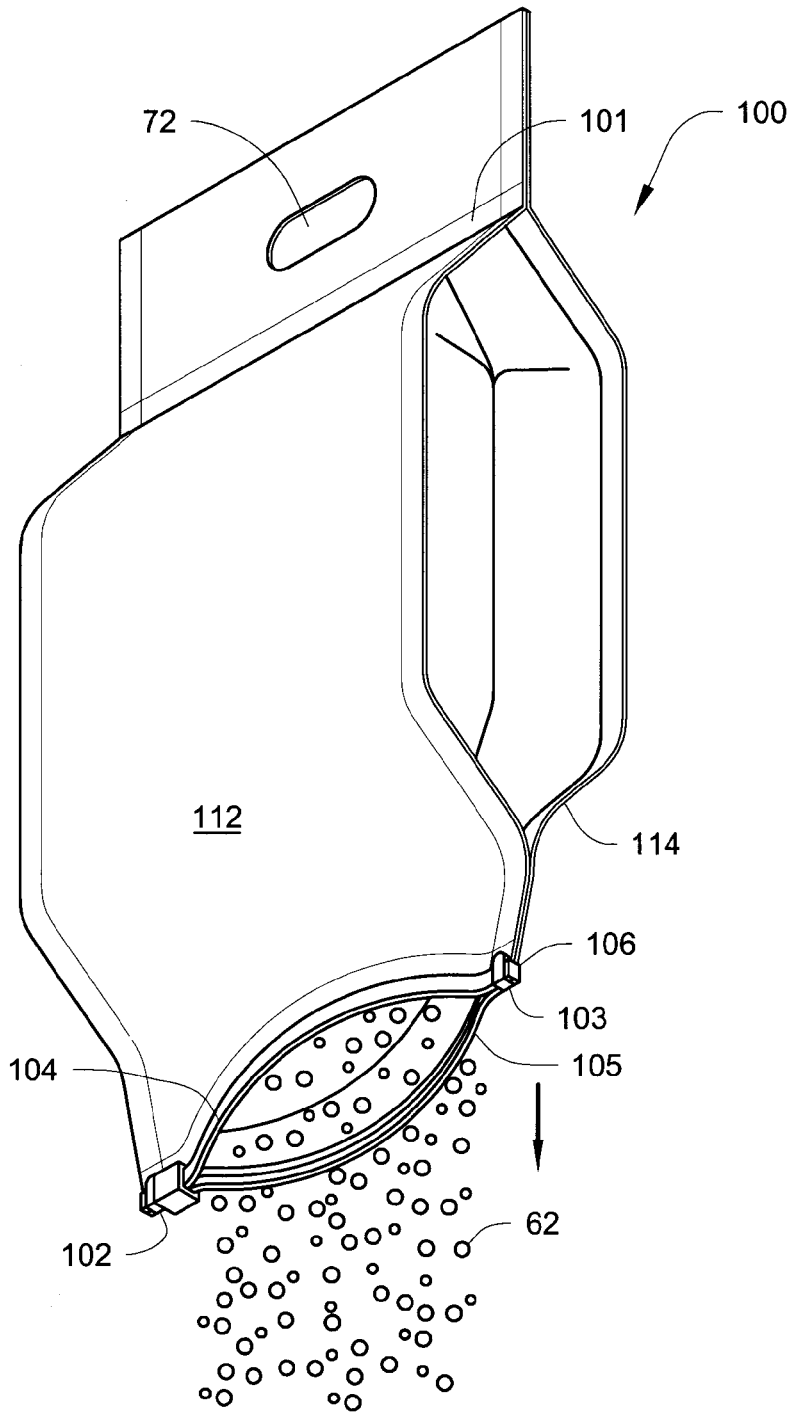
FIG. 7 is a perspective view of a bag construction disclosed herein after a step of opening a transverse openable and reclosable closure mechanism for distributing dispersible materials.
Figure 8:
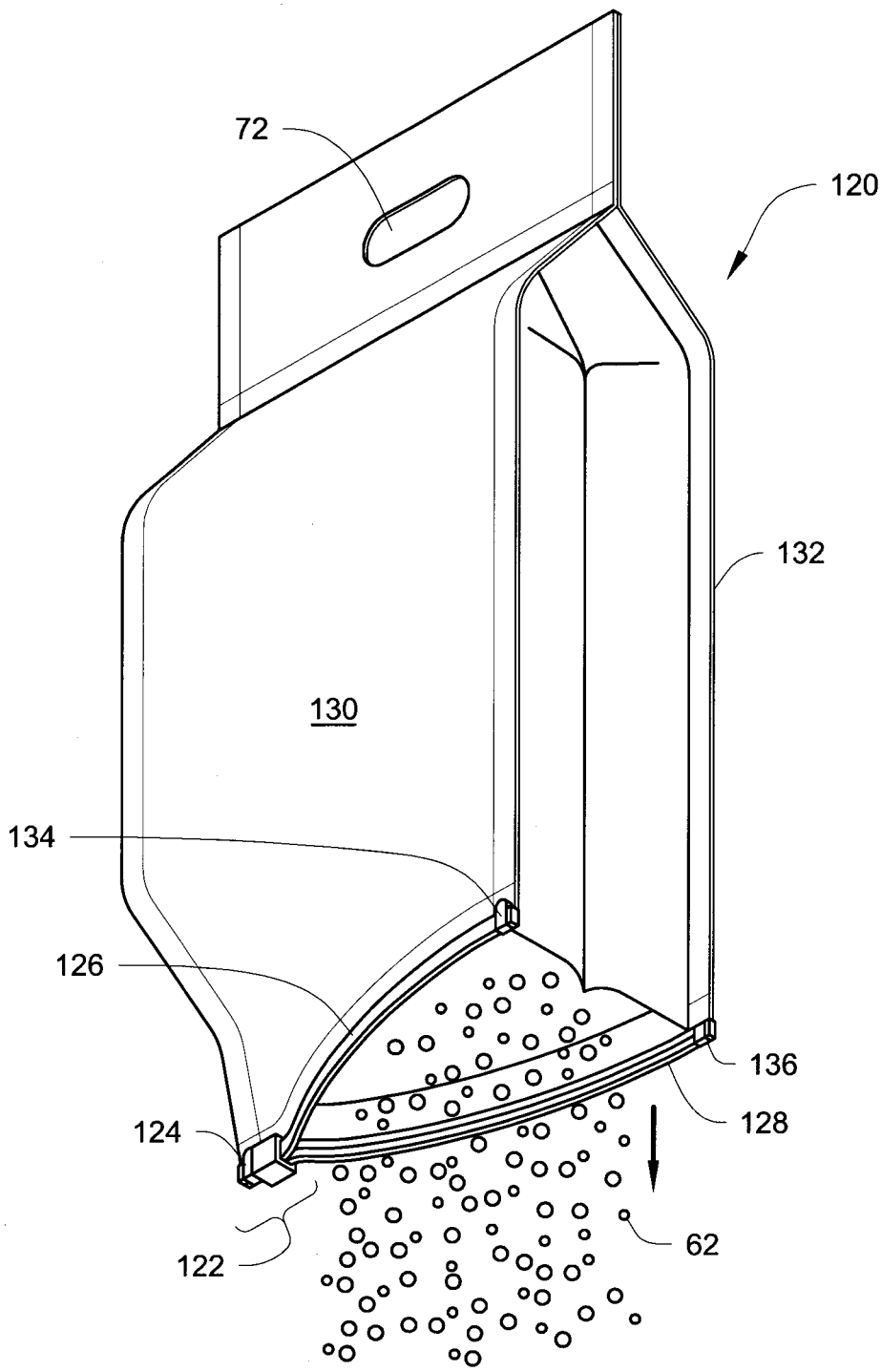
FIG. 8 is a perspective view of another bag construction disclosed herein after a step of opening a transverse openable and reclosable closure mechanism for distributing dispersible materials.

Such arrangements are available, for example, from Pactiv Corporation. The sliding zipper rails 68, 69 may be secured to the bag constructions 10, 610 by a variety of appropriate means, for example by mechanical means, heat sealing, with an adhesive, or other convenient manners. Examples of mechanical means for securing sliding zipper rails 68, 69 include tabs that interlock and positioned at least partially around one or more of the zipper rails 68, 69. Such tabs may also provide a stop for the slidable tab 66. FIGS. 7 and 8 also illustrate different embodiments of an openable and reclosable closure arrangement.

Alternatively, a bottom gusset panel section 200 which includes an openable and reclosable closure arrangement 204 may be sealed to second ends of first and second panel sections 12, 14, as illustrated in FIGS. 4C, 4D, 4E and 4F.

In FIGS. 4A, 4B, 4C, 4D, 4E and 4F, various embodiments of openable and reclosable closure arrangements and anti-tamper arrangements are illustrated.

Figure 4C:
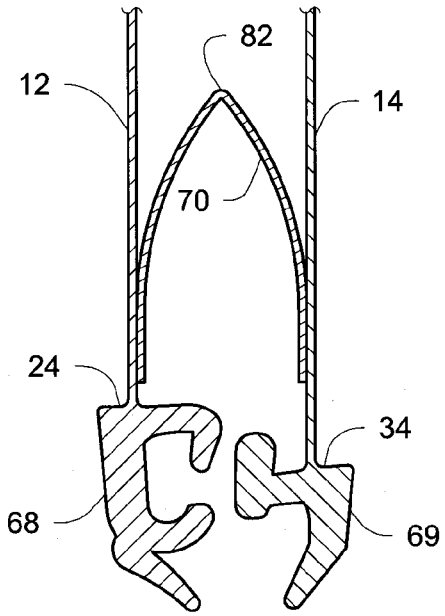
FIG. 4C is a portion of a cross-sectional side view of a bag construction showing an embodiment of an openable and reclosable closure mechanism, and an embodiment of an anti-temper seal arrangement.

Attention is now directed to FIGS. 4A, 4B and 4C. In FIGS. 4A and 4B, closer perspective views of an example of an anti-tamper arrangement 70 are illustrated. In FIG. 4C, a side sectional view of an example of an anti-tamper arrangement 70 is illustrated. FIG. 4A illustrates a transverse openable and reclosable closure mechanism 64 in an opened state wherein the anti-tamper arrangement 70 remains intact to keep the interior of a bag construction 10 substantially separated from the outside. The anti-tamper arrangement 70 may have a predetermined tear-line 82. The predetermined tear-line 82 may provide a readily openable seal such that a user may open the anti-tamper arrangement 70 simply by pulling it apart or with a quick pull. FIG. 4B illustrates the anti-tamper arrangement 70 having been torn or opened to allow access to and from the interior of the bag construction 10 to the outside. Advantageously, the anti-tamper arrangement 70 may help protect the dispersible material 62 from degradation which may result from contact with outside environments. Also advantageously, the anti-tamper arrangement 70 may help in giving assurance to a consumer that the product is new and/or unused.

In FIG. 4C, the anti-tamper arrangement 70, as illustrated, is positioned between the first panel section 12 and the second panel section 14, along the second end edges 24, 34, of the first and second panel sections, 12, 14. The anti-tamper arrangement 70 may be positioned between the second end edges 24, 34 and the internal gusset member 20. The anti-tamper arrangement 70 as illustrated is attached at least partly to the first panel section 12 and also attached at least partly to the second panel section 14.

Alternatively, an anti-tamper arrangement may be an integral part of a bottom gusset panel section 200 which also includes a transverse openable and reclosable closure arrangement 204, as disclosed below.

Figure 4D:
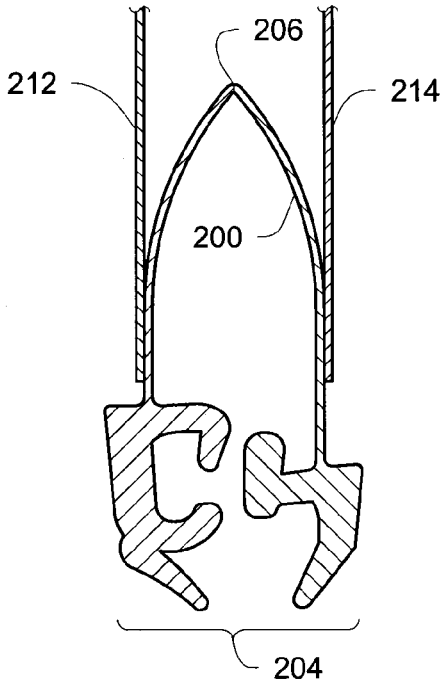
FIG. 4D is a portion of a cross-sectional side view of another bag construction showing an embodiment of an openable and reclosable closure mechanism with an embodiment of an anti-temper seal arrangement.

In FIG. 4D, a bottom gusset panel section 200 includes an anti-tamper arrangement 206 and also includes an openable and reclosable closure arrangement 204. First panel section 212 and second panel section 214 are attached or sealed to the bottom gusset panel section 200.

Figure 4E:
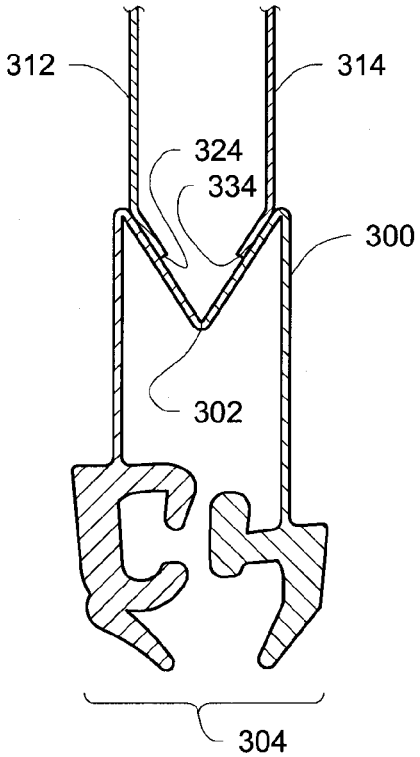
FIG. 4E is a portion of a cross-sectional side view of a bag construction showing an embodiment of an openable and reclosable closure mechanism with a further embodiment of an anti-temper seal arrangement.

FIG. 4E illustrates another embodiment wherein a bottom gusset panel section 300 includes multiple fold lines, an anti-tamper arrangement 302 at one of the fold lines, and an openable and reclosable closure arrangement 304. First panel section 312 and second panel section 314 are attached or sealed to the bottom gusset panel section 300.

Figure 4F:
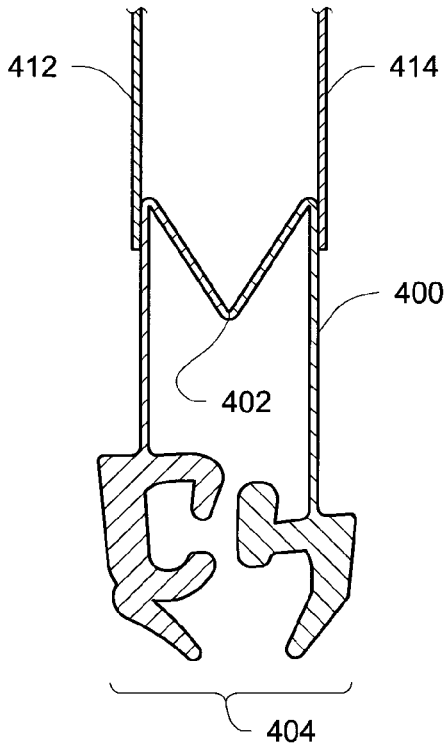
FIG. 4F is a portion of a cross-sectional side view of a bag construction showing an embodiment of an openable and reclosable closure mechanism with a still further embodiment of an anti-temper seal arrangement.

FIG. 4F illustrates yet another embodiment wherein a bottom gusset panel section 400 includes multiple fold lines, an anti-tamper arrangement 402 at one of the fold lines, and an openable and reclosable closure arrangement 404. First panel section 412 and second panel section 414 are attached or sealed to the bottom gusset panel section 400.

As illustrated in FIG. 4E, the embodiment has an anti-tamper arrangement 302 that may extend beyond the second end edges 324, 334, of the first and second panel sections, 312, 314, and towards an openable and reclosable closure arrangement 304.

Also illustrated in FIG. 4F, the embodiment has an anti-tamper arrangement 402 that may extend beyond the second end edges 424, 434, of the first and second panel sections, 412, 414, and towards an openable and reclosable closure arrangement 404.

Closure arrangements including an anti-tamper arrangement are available, for example, under the trademark Slide-Rite® from Pactive Corporation.

It is preferable, as shown in FIGS. 1, 5-8, and 10, that a bag construction include a handle aperture 72. The handle aperture 72 may help facilitate in the use of a bag construction to distribute the dispersible materials 62. The handle aperture 72 may also help facilitate in the transport of and storage of a bag construction according to the present invention.

Attention is now directed to FIGS. 5-8. From a review of these figures, a method of filling and operation of bag construction will be understood.

Figure 5:
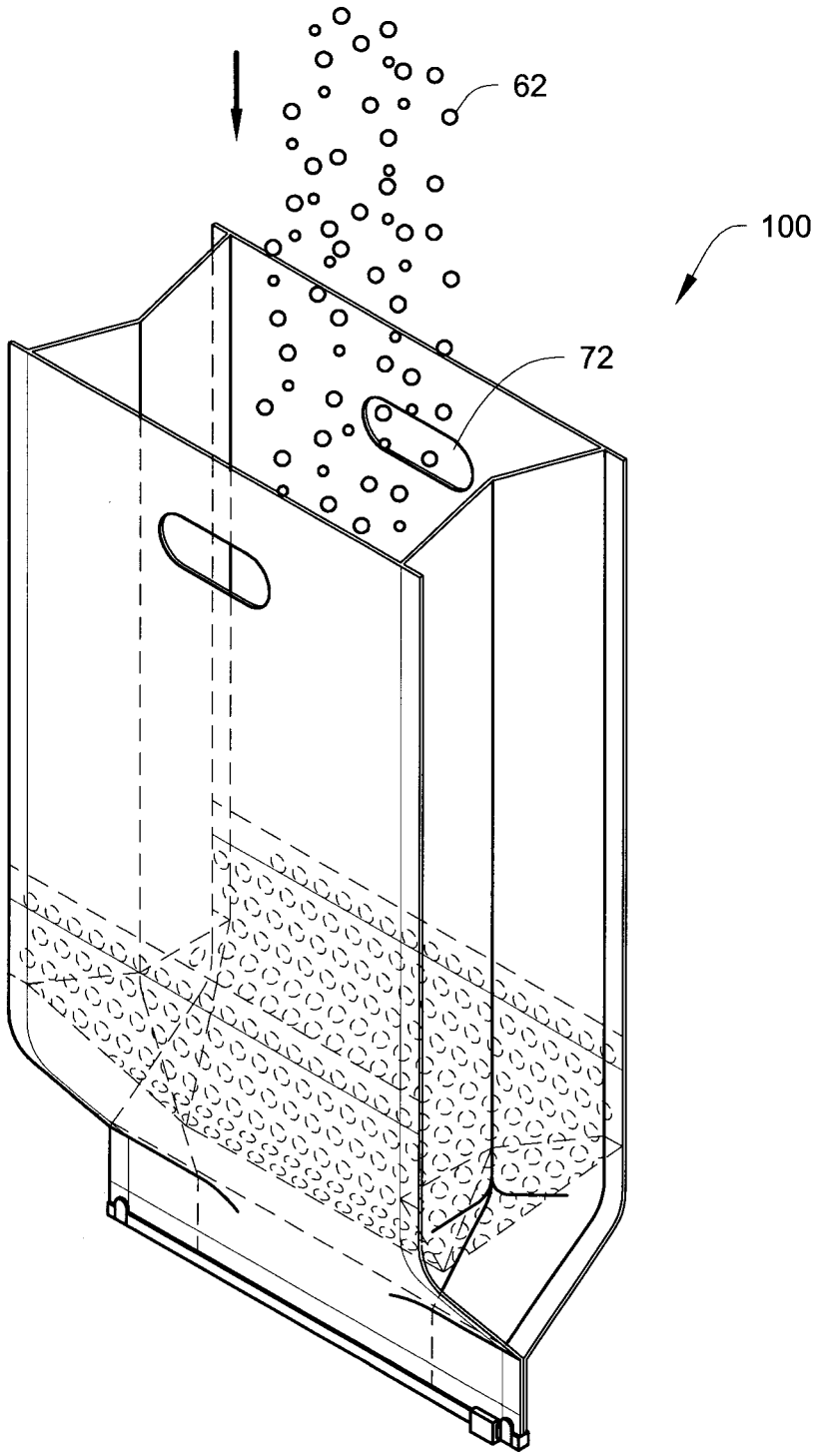
FIG. 5 is a perspective view of a bag construction being filled with dispersible materials.
Figure 6:
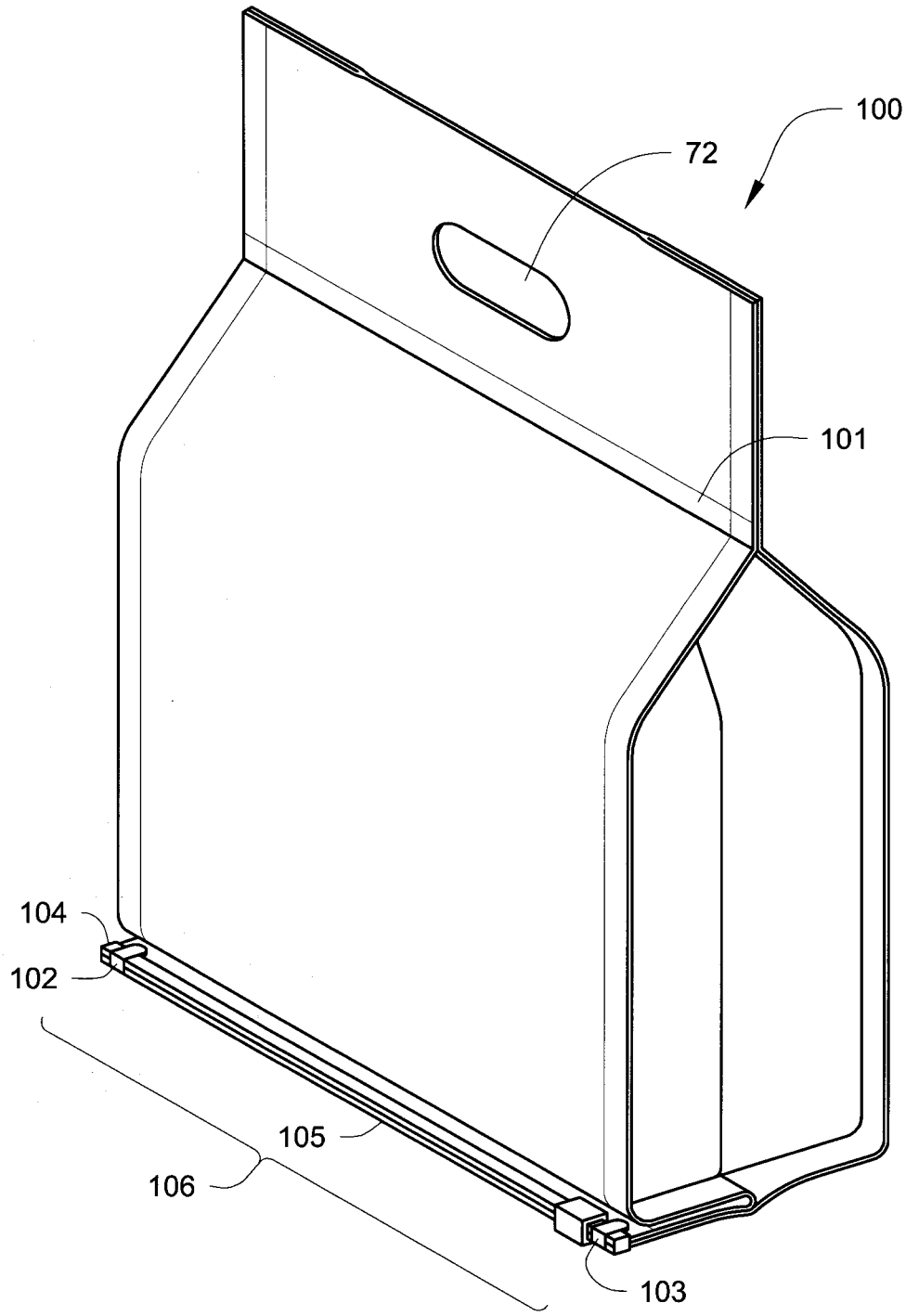
FIG. 6 is a perspective view of a bag construction positioned to an upright standing position after being filled with dispersible materials.

Referring to FIGS. 5 and 6, bag construction 100 is depicted as it is being filled with dispersible material 62. After a bag construction is filled with dispersible material 62, preferably, a transverse seal 101 is sealed.

FIG. 6 illustrates the up-right standing position possible with a bag construction 100 after filling. From the bag construction 100 illustrated in FIG. 6, those skilled in the art will appreciate the advantages of such bag construction 100 for storage and/or product placement at point-of-sale.

Referring to FIG. 7, a bag construction 100 being used to distribute dispersible materials 62 is illustrated. FIG. 7 illustrates an embodiment wherein an openable and reclosable arrangement 106 is shown at an open state. When in this open state, both a first end tab 102 and a second end tab 103 saddles the first rail 104 and the second rail 105 of an openable and reclosable arrangement 106. Therefore, the first panel section 112 and the second panel section 114 are held in close proximity. A user may hold onto the handle aperture 72 of the bag construction 100 as dispersible materials 62 flow and fall out from the internal compartment of the bag construction 100. After use, the openable and recloseable arrangement 106 may be closed and the bag construction 100 may be stored for further future use. In this regard, FIG. 6 illustrates a possible positioning when such bag construction 100 is stored for future use. Alternatively, the bag construction 100 may be stored on its side or any other position desired by a user.

Referring to FIG. 8, a bag construction 120 being used to distribute dispersible materials 62 is illustrated. An openable and reclosable closure arrangement 122 is shown at an open state. FIG. 8 illustrates an embodiment wherein a first end tab 124 saddles a first rail 126 and a second rail 128 and thereby positioning the first panel section 130 and the second panel section 132 in close proximity at the location of the first end tab 124. A second tab 134 saddles the first rail 126 and is attached or sealed to the first panel section 130. A third tab 136 saddles the second rail 128 and is attached or sealed to the second panel section 132. Thus, when in the open state, this embodiment of an openable and reclosable closure arrangement 122 may allow for a larger opening than the embodiment illustrated in FIG. 7. When in the closed state, this embodiment may resemble the embodiment illustrated to be in a closed state as shown in FIG. 6.

Figure 9:
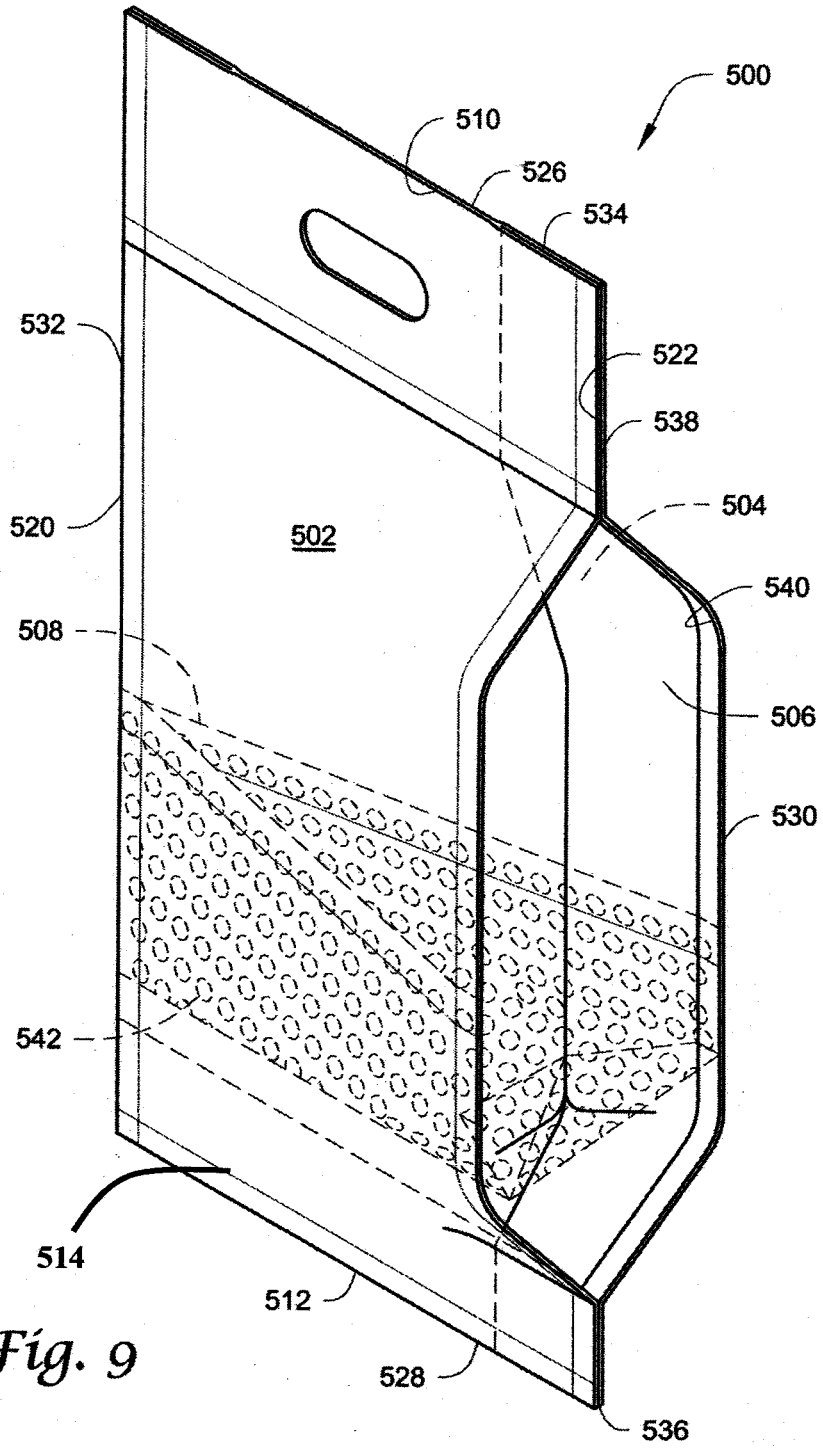
FIG. 9 is a perspective view of another embodiment of a bag construction disclosed herein.

Referring to FIG. 9, another embodiment of a bag construction 500 is shown as it would generally appear prior to use without any material contained inside to facilitate viewing of internal detail. The bag construction 500 comprises first panel section 502 opposed to second panel section 504; a side gusset panel section 506; and internal gusset member 508 positioned inside the bag construction 500.

Still referring to FIG. 9, the first panel section 502 comprises a first end edge 510, a second end edge 512, a first side edge 520, and a second side edge 522. The first end edge 510 opposes the second end edge 512. The first side edge 520 opposes the second side edge 522.

The second panel section 504 comprises a first end edge 526, a second end edge 528, a first side edge 530, and a second side edge 532. The first end edge 526 opposes the second end edge 528. The first side edge 530 opposes the second side edge 532.

The side gusset panel section 506 comprises a first end edge 534, a second end edge 536, a first side edge 538, and a second side edge 540. The first end edge 534 opposes the second end edge 536. The first side edge 538 opposes the second side edge 540.

Referring still to FIG. 9, at least a portion of the first panel section's first side edge 520 is secured to at least a portion of the second side edge 532 of the second panel section 504. At least a portion of the second side edge 522 of the first panel section 502 is secured to at least a portion of the first side edge 538 of the side gusset panel section 506. At least a portion of the first side edge 530 of the second panel section 504 is secured to at least a portion of the second side edge 540 of the side gusset panel section 506.

FIG. 9 illustrates the second end edges 512, 528, of the first panel section 502 and the second panel section 504, as being at least partly sealed. Accordingly, prior to use, the second end edges 512, 528 of the bag construction 500 may be cut or torn transversely across the bag construction 500. To aid in tearing or cutting of the second end edges 512, 528, a tear-line 514 may be provided with or without a notch to ease the beginning of the tearing process. Alternatively, other securing means may be utilized at the second end edges of a bag construction, including, but not limited to, openable and reclosable closure arrangements disclosed herein. Furthermore, examples of bottom panel gusset panel sections illustrated in FIGS. 4C, 4D, 4E, and 4F may also be included at the second end edges 512, 528, of the bag construction.

The internal gusset member 508, as illustrated in FIG. 9, can be seen to be perforated and has at least one distribution aperture 542. Securing methods that can be utilized to secure the edges include, but are not limited to: heat sealing, glues, sewing, and/or any combinations thereof, as well as any other conventional seals that are used for the formation of bag construction.

Referring to FIG. 10, a bag construction 610 is shown without any material contained inside to facilitate viewing of internal detail. Further, FIG. 13 illustrates a perspective cross-sectional view taken generally along line 13-13 of FIG. 10. Thus, FIG. 13 may further facilitate viewing of the internal detail. The bag construction 610 comprises first panel section 612 opposed to second panel section 614; first side gusset panel section 616 opposed to second side gusset panel section 618; and internal gusset member 620 positioned inside the bag construction 610.

Still referring to FIG. 10, the first panel section 612 comprises a first end edge 622, a second end edge 624, a first side edge 626, and a second side edge 628. The first end edge 622 opposes the second end edge 624. The first side edge 626 opposes the second side edge 628.

The second panel section 614 comprises a first end edge 632, a second end edge 634, a first side edge 636, and a second side edge 638. The first end edge 632 opposes the second end edge 634. The first side edge 636 opposes the second side edge 638.

The first side gusset panel section 616 comprises a first end edge 642, a second end edge 644, a first side edge 646, and a second side edge 648. The first end edge 642 opposes the second end edge 644. The first side edge 646 opposes the second side edge 648.

The second side gusset panel section 618 comprises a first end edge 652, a second end edge 654, a first side edge 656, and a second side edge 658. The first end edge 652 opposes the second end edge 654. The first side edge 656 opposes the second side edge 658.

Referring still to FIG. 10, the first side gusset panel section 616 has a length extending from the first end edge 642 to the second end edge 644, wherein the length is shorter than a length of the first panel section 612 length from the panel section first end edge 622 to the second end edge 624. Similarly, the second side gusset panel section 618 has a length extending from the first end edge 652 to the second end edge 654 that is shorter than the length of the first panel section 612 from the panel section first end edge 622 to the second end edge 624.

A tape 660 is disposed transversely extending from the first side edge 636 to the second side edge 638 on an inside surface of the second panel section 614. Thus, the tape 660 is in the interior space of the bag construction 610. As illustrated in FIG. 10, the tape 660 is disposed near the second end edges 644, 654 of the first and second side gusset panel sections 616, 618. The tape 660 secures at least a portion of the second end edges 644, 654 of the first and second side gusset panel sections 616, 618 to the inside surface of the second panel section 614. Alternatively or additionally, the tape 660 may secure at least a portion of the second end edges 644, 654 of the first and second side gusset panel sections 616, 618 to at least a portion of the inside surface of the second panel section. 614. The tape 660 may be of a polymer. An adhesive may be used to secure the tape 660 to the other portions of the bag construction 610. A heat sealing method may also be used to secure the tape 660 to the bag construction 610.

At least a portion of the first panel section's first side edge 626 is secured to at least a portion of the first side gusset panel section's second side edge 648. At least a portion of the first side gusset panel section's first side edge 646 is secured to at least a portion of the second panel section's second side edge 638. At least a portion of the second panel section's first side edge 636 is secured to at least a portion of the second side gusset panel section's second side edge 658. And, at least a portion of the second side gusset panel section's first side edge 656 is secured to at least a portion of the first panel section's second side edge 628. Some examples of securing methods that can be utilized include, but are not limited to: ultra-sonic welding, heat sealing, glues, sewing, and/or any combinations there of. Those skilled in the art will appreciate that there are many different methods of securing the aforementioned panel sections in the aforementioned configuration to form the bag construction according to the present invention.

Figure 11B:
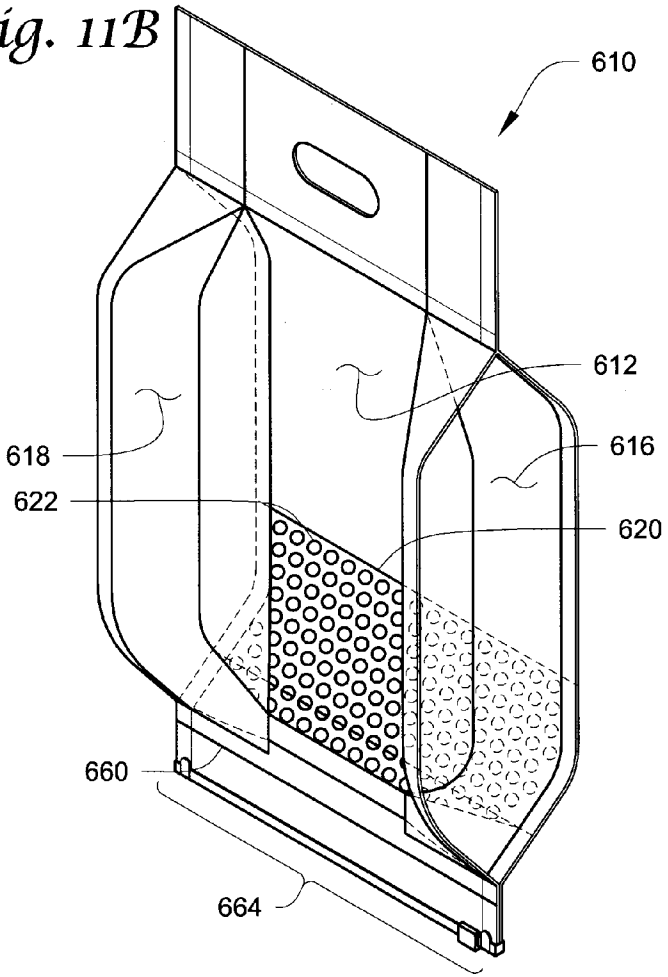
FIG. 11B is a perspective view of the bag construction as shown in FIG. 11A.
Figure 11A:
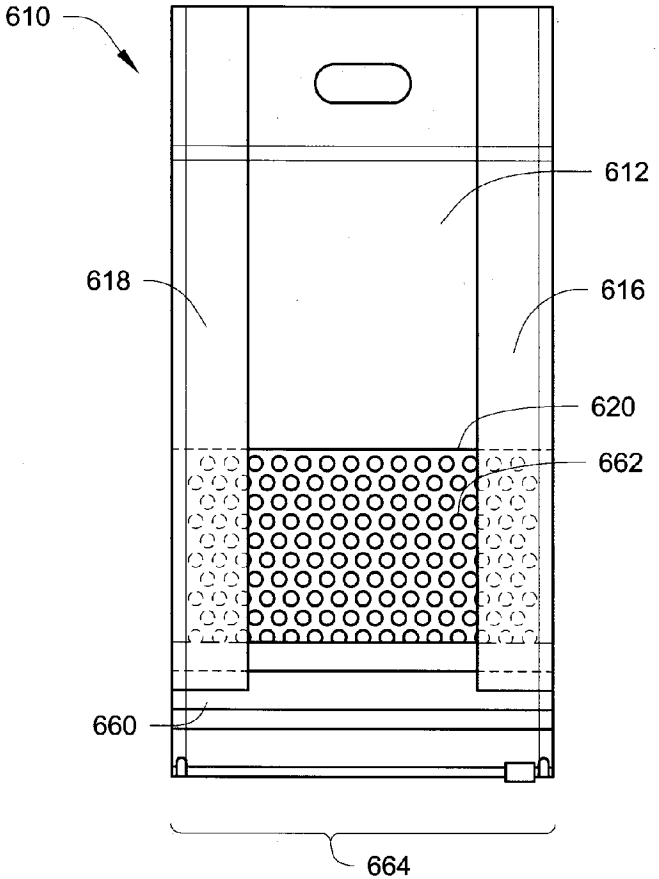
FIG. 11A is a front side view of a bag construction without showing a facing panel section of the bag construction of FIG. 10.
Figure 12:
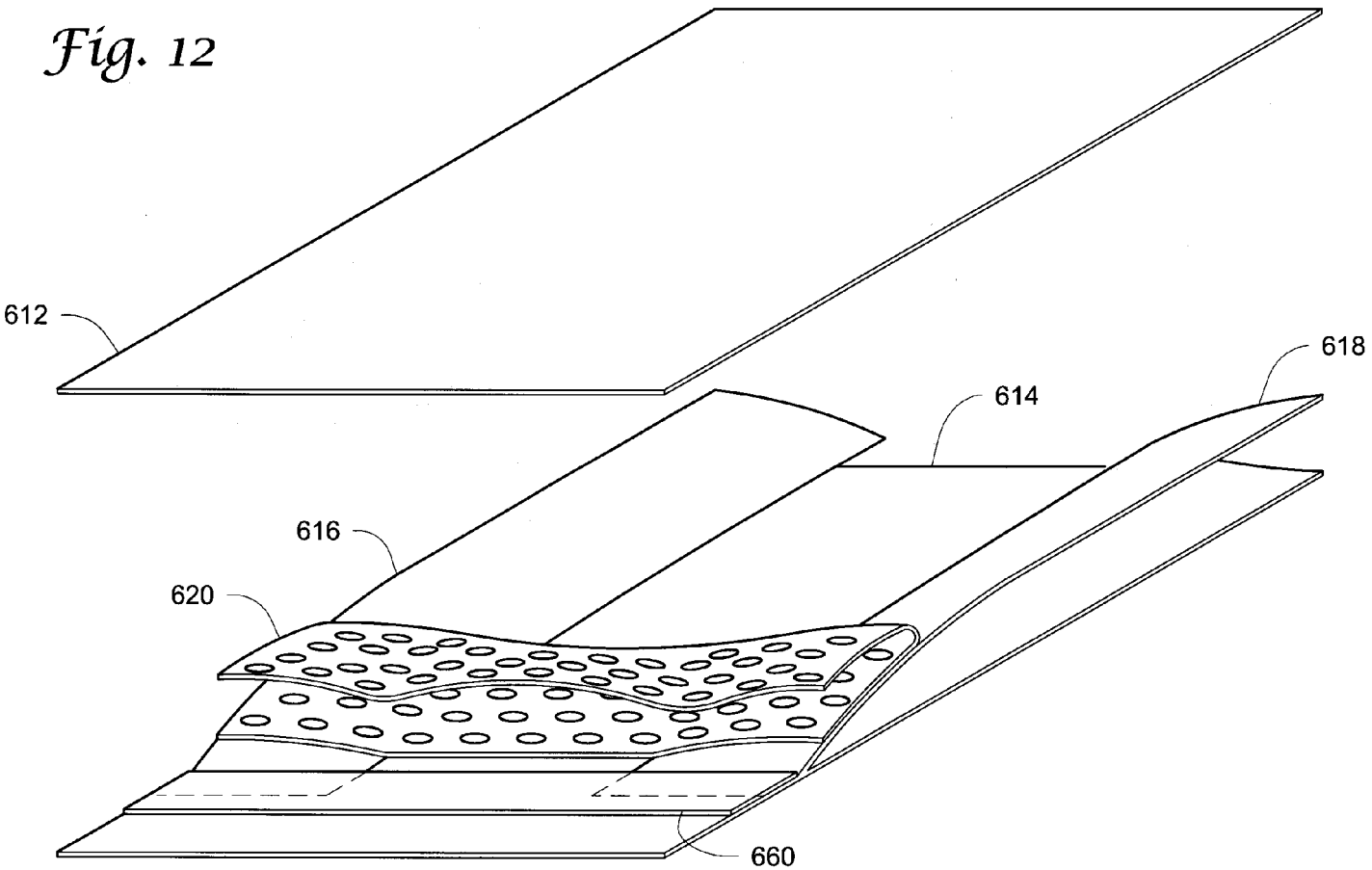
FIG. 12 is a partial exploded view of a bag construction disclosed herein, with one panel section detached.

In FIGS. 11A and 11B, the internal gusset member 620 can be seen to be perforated and has at least one distribution aperture 662. In FIGS. 11A and 11B, the distribution aperture 662 is shown to be a hole, but other forms and shapes may also be utilized. Preferably, shapes, sizes, and forms of distribution aperture 620 will be selected to allow for desirable passage of dispersible materials 62 in a desirable manner. Preferably, the internal gusset member 620 is made, in part, of a flexible material. Examples of flexible material that may be suitable include, but not limited to: polymers, cloth fabric, paper, weaved synthetic materials, weaved natural materials, and sheet of organic material. It is also shown in FIGS. 11A, 11B, and also in FIG. 12 that the internal gusset member 620 may be secured to the first panel section 612. As it is shown in FIG. 12, the internal gusset member 620 may be positioned between the side gusset panel sections 616, 618 and the first panel section 612. Accordingly, the internal gusset member 620 may be secured to either or both side gusset panel sections 616, 618. Further, the internal gusset member 620 may be secured to the second panel section 614. Preferably, the internal gusset member 620 is secured to the first and second panel sections 612, 614, and both side gusset panel sections 616, 618.

FIG. 14 illustrates a portion of a perspective cross-sectional view of the bag construction shown in FIGS. 10 and 13. The transverse openable and reclosable closure mechanism 664 is illustrated in FIG. 14 in an opened state with the anti-tamper seal arrangement 666 intact. Various different types of openable and reclosable closure mechanisms and anti-tamper seal arrangements already disclosed above and in FIGS. 4A, 4B, 4C, 4D, 4E and 4F may also be used for the bag construction 610.

Bag constructions may be manufactured from a variety of materials. It is particularly advantageous, however, that they be constructed, at least partly, from relatively thin, strong material such as polyester biaxially oriented nylon liner low density polyethylene (PET/BON/LLDPE) film.

It is preferable that the side gusset panel sections are made of at least two different layers of materials. The materials may be selected from, but not limited to, the following: Polyester, Nylon, Linear Low Density Polyethylene (LLDPE), Aluminum, and Metalized Polyester. Further, an adhesive material layer may be included between the above materials. Multiple combinations of materials making up multiple layers are thus possible. For example, the following combinations, some with multiple layers or ply of the same material, may be used for any sections of the bag construct:

1. Polyester/adhesive/Linear Low Density P.E film (2-ply)
2. Polyester/adhesive/Aluminum foil/adhesive/LLDPE (3-ply)
3. Polyester/adhesive/Metalized Polyester//adhesive/LLDPE (3-ply)
4. Polyester/adhesive/Nylon/adhesive/LLDPE (3-ply)
5. Polyester/adhesive/Nylon/adhesive/Aluminum Foil/adhesive/LLDPE
6. Nylon/adhesive/LLDPE (2-ply)
7. Nylon/adhesive/Metalized Polyester/adhesive/LLDPE (3-ply)
8. Nylon/adhesive/Aluminum Foil/adhesive/LLDPE (3-ply)
9. Nylon/adhesive/Nylon/adhesive/LLDPE (3-ply)
10. Nylon/adhesive/Nylon/adhesive/Aluminum Foil/LLDPE (3-ply)

Other materials such as Polypropylene may also be used in place of the above or in combination with the other materials. Material thickness may also vary.

Preferred embodiments which are particularly useful, and which include advantages according to the present invention, may be constructed wherein the first and second panel sections comprise first and second sheets of PET/BON/LLDPE 3-ply. Alternatively, a combination of PET/BON/LLDPE layer with one or more layers of different melting temperature may also be used. Similar materials may be utilized for the internal gusset member (with appropriate aperture or slit therein). Preferably, heat sealable film is utilized so that the means for securing the panel sections to another, securing the closure means and panel sections, and securing the internal gusset member in place is by heat seals, without the need for additional adhesive.

The film materials are available in three substrates and may be laminated together in a conventional adhesive lamination process. The polyester substrate has an adhesive applied, then the nylon substrate is applied. The polyester substrate and nylon substrate are laminated together. This resulting layer is coated with the liner low density polyethylene substrate, and then laminated together.

A preferred embodiment has been described for illustrative purposes. Those skilled in the art will appreciate that various modifications, additions and substitutions are possible, without departing from the scope and spirit of the invention as claimed and disclosed, including the full scope of equivalents thereof.

What is claimed:

1. A bag construction, comprising:

(a) first and second panel sections, each including:
- (i) a first end edge, a second end edge, a first side edge, and a second side edge;
- (ii) wherein the first end edge oppose the second end edge;
- (iii) wherein the first side edge oppose the second side edge;
- (iv) wherein the first side edge extends from the first end edge to the second end edge;
- (v) wherein the second side edge extends from the first end edge to the second end edge; and
- (vi) the second panel section including a first length, wherein the first length is measured from the second panel section's first end edge to the second panel section's second end edge;

(b) a first side gusset panel section including:
- (i) a first end edge, a second end edge, a first side edge, and a second side edge;
- (ii) wherein the first end edge opposes the second end edge;
- (iii) wherein the first side edge opposes the second side edge;
- (iv) wherein the first side edge extends from the first end edge to the second end edge;

(v) wherein the second side edge extends from the first end edge to the second end edge; and (vi) the first side gusset panel section including a second length, wherein the second length is measured from the first side gusset panel section's first end edge to the first side gusset panel section's second end edge and the second length is shorter than the first length;

(c) the panel sections and the side gusset panel section being secured in the following manner to define a bag construction interior:

(i) at least a portion of the first panel section's first side edge being secured to at least a portion of the first side gusset panel section's second side edge; and (ii) at least a portion of the first side gusset panel section's first side edge being secured to at least a portion of the second panel section's second side edge;

(d) an internal gusset member;

(i) the internal gusset member positioned inside the bag construction interior; and (ii) the internal gusset member including at least one distribution aperture therein;

(e) a transverse openable and reclosable closure arrangement extending between the first and second panel sections at the second end edges of the first and second panel sections;

(f) a tape disposed transversely extending from the first side edge to the second side edge on an inside surface of the second panel section securing at least a portion of the second end edge of the first side gusset panel section to at least a portion of the inside surface of the second panel section and not securing the inside surface of the second panel section to the inside surface of the first panel section;

(g) a second side gusset panel section including:

(i) a first end edge, a second end edge, a first side edge, and a second side edge;

(ii) wherein the first end edge opposes the second end edge;

(iii) wherein the first side edge opposes the second side edge;

(iv) wherein the first side edge extends from the first end edge to the second end edge;

(v) wherein the second side edge extends from the first end edge to the second end edge; and (h) the panel sections and the side gusset panel sections being further secured in the following manner:

(i) at least a portion of the second panel section's first side edge being secured to at least a portion of the second side gusset panel section's second side edge; and (ii) at least a portion of the second side gusset panel section's first side edge being secured to at least a portion of the first panel section's second side edge;

(i) the second side gusset panel section including a third length, wherein the third length is measured from the second side gusset panel section's first end edge to the second side gusset panel section's second end edge, wherein the third length is shorter than the first length; and wherein the tape secures at least a portion of the second end edge of the second side gusset panel section to at least a portion of the inside surface of the second panel section and not securing the inside surface of the second panel section to the inside surface of the first panel section; and (j) wherein the internal gusset member is secured to a part of the inside surface of the first side gusset panel section and further includes a fold line positioned between the part of the inside surface where the internal gusset member is secured to and the first panel section's first side edge.

2. The bag construction according to claim 1, further comprising:

an anti-tamper arrangement, wherein the anti-tamper arrangement including a tear member sealed, at least partly, to each of the first and second panel sections, and wherein the anti-tamper arrangement being positioned between the transverse openable and reclosable closure arrangement and the tape.

3. The bag construction according to claim 1, wherein the internal gusset member is secured to a part of the first and second side gusset panel sections and further includes a fold line positioned between the part of the first and second side gusset panel sections where the internal gusset member is secured to and the first panel section's first end edge.

4. The bag construction according to claim 1, wherein the first and the second side gusset panel sections are each formed of at least two different layers of materials.

5. The bag construction according to claim 4, wherein the material is selected from the group consisting of Adhesive, Polyester, Nylon, Linear Low Density Polyethylene, Aluminum, Polypropylene, and Metalized Polyester.

6. The bag construction according to claim 1, further comprising:

(a) an anti-tamper arrangement;

(i) the anti-tamper arrangement including a tear member sealed, at least partly, to each of the first and second panel sections; and (ii) the anti-tamper arrangement being positioned between the transverse openable and reclosable closure arrangement and the internal gusset member.

* * * * *